US006666411B1

(12) United States Patent
Hart et al.

(10) Patent No.: US 6,666,411 B1
(45) Date of Patent: Dec. 23, 2003

(54) COMMUNICATIONS-BASED VEHICLE CONTROL SYSTEM AND METHOD

(75) Inventors: Harvey R. Hart, Alliston (CA); Jeff McCabe, Barrie (CA)

(73) Assignee: Alcatel, Paris (FR)

( * ) Notice: Subject to any disclaimer, the term of this patent is extended or adjusted under 35 U.S.C. 154(b) by 19 days.

(21) Appl. No.: 10/157,859

(22) Filed: May 31, 2002

(51) Int. Cl.[7] ..... B61L 3/00

(52) U.S. Cl. ..... 246/62; 246/1 C; 246/3; 246/14; 246/182 R

(58) Field of Search ..... 246/1 C, 3, 14, 246/2 S, 22, 23, 27, 28 R, 62, 122 R, 167 R, 182 R, 182 B, 182 C

(56) References Cited

U.S. PATENT DOCUMENTS

| | | | | | |
|---|---|---|---|---|---|
| 4,735,383 | A | | 4/1988 | Corrie | |
| 4,864,306 | A | | 9/1989 | Wiita | |
| 5,006,847 | A | | 4/1991 | Rush et al. | |
| 5,036,478 | A | | 7/1991 | MacDougall | |
| 5,055,835 | A | | 10/1991 | Sutton | |
| 5,332,180 | A | * | 7/1994 | Peterson et al. | 246/3 |
| 5,364,047 | A | * | 11/1994 | Petit et al. | 246/122 R |
| 5,437,422 | A | | 8/1995 | Newman | |
| 5,452,870 | A | * | 9/1995 | Heggestad | 246/182 R |
| 5,533,695 | A | * | 7/1996 | Heggestad et al. | 246/62 |
| 5,740,046 | A | | 4/1998 | Elestedt | |
| 5,784,005 | A | | 7/1998 | Akutsu et al. | |
| 5,924,653 | A | * | 7/1999 | Pedersen et al. | 246/167 R |
| 5,995,881 | A | * | 11/1999 | Kull | 246/182 B |

OTHER PUBLICATIONS

Communications Based Train Control, Transportation Systems Design, Inc., (no date).

Chronology of Train Control : http://www.wws.princeton.edu/cgi–bin/byteserv.prl/–ota/disk3/1976/7614/761414.PDF, no date.

Railroad Terminology, Slang and Definitions; http://www.k-sry.com/terms.htm, no date.

ASME/IEEE RVTIS Abbreviations/Definitions, no date.

Precision Train Control System; GE Harris Railway Electronics, pp. 1–9, no date.

Railway Technical Web Pages—Railway Signalling—Basics of UK Systems; http://www.trainweb.org/railwaytechnical/sigtxt1.html no date.

DLR Signally—The Fixed–block System; Docklands Light Rail, no date.

Railway Technology—Andrew Distributed Communications Systems; The Website for the Railway Industry; http://www.railway–technology.com/contractors/signal/adcs/index.html, (no date).

Railroad Signalling: Basics; Railroad Rules, Signalling, Operations: Carsten S. Lundsten; Updated 980927; Apr. 17, 2001.

(List continued on next page.)

*Primary Examiner*—Mark T. Le
(74) *Attorney, Agent, or Firm*—Sughrue Mion, PLLC

(57) ABSTRACT

A vehicle control system and method in which a plurality of beacon tags are disposed along a length of a track for a predetermine number of blocks. The beacon tags each provide information pertaining its location. Each vehicle that passes along the track has a tag reader that solicits information from the beacon tags and a transmitter that transmits the solicited information, as well as vehicle identification information for the transmitting vehicle, to a wayside control unit. The wayside control unit receives the transmitted position information and vehicle identification information and in turn transmits a single broadcast of information pertaining to each of the blocks of the predetermined number of blocks. This signal is received by all of the vehicles, which use only the information about immediately approaching blocks. In addition, dynamic tags located at positions along the length of the predetermine number of blocks can be used as a backup system for providing the same information that is provided by the wayside control unit.

24 Claims, 2 Drawing Sheets

OTHER PUBLICATIONS

Electro–Pneumatic Block Signal System; Scientific American—Apr. 5, 1890.

International Railway Journal—Editoral—May 2000; Railways Agree ERTMS Specifications.

CBTC Projects—Transportation Systems Design, Inc.; http://www.tsd.org/cbtcprojects.htm, no date.

Alcatel Transport Automation Systems—Signalling and Telecommunications— http://www.railway–technology.com/contractors/signal/alcatel/index.html, no date.

Locomotive Engineers Journal, Summer 2000, vol. 107—No. 2. The Issues: Positive Train Control.

Railway Age, Aug. Highlights; Feb. 22, 2001.

Railway Age, Jun. Highlights, CBTS: A Maturing Technology; http://www.railwayage.com/jun99/cbtc.html, no date.

GE Harris Railway Electronics Products, Precision Train Control; http://209.114.213.146/products/pct.html, no date.

Railway Signalling and Operations FAQ; http://broadway.pennsyrr.com/Rail/Signal/, no date.

The ABCs of Spread Specrum—A Tutorial—Banners; http://sss–mag.com/ss.html Acronyms, no date.

* cited by examiner

COMMUNICATIONS-BASED VEHICLE CONTROL SYSTEM AND METHOD

FIELD OF THE INVENTION

The present invention relates generally to an improved system and method of vehicle control. More specifically, the present invention is directed to a Communications based Train Control (CBTC) system that utilizes low-cost, readily available hardware to control and direct various trains in a safe and efficient manner.

BACKGROUND OF THE INVENTION

For over a hundred years the movement of trains, or other track guided vehicles, has been controlled such that increasing numbers of vehicles can operate within a network of tracks in a safe and efficient manner. Both people and freight are transferred on trains between locations separated by distances ranging from hundreds of feet to thousands of miles. With a single train running on a single track or network of tracks, with no obstacles, control of the train is simple. Since there is little concern for the train coming into contact with any other objects, the train can run at maximum speed, limited only by the speed performance of the train, the train's stopping ability once it reaches its destination, and the train's ability to stay on the track, i.e., while travelling around turns, etc.

However, as additional trains are placed on the track, or track network, to take advantage of the unused capacity of the tracks and provide viable transportation alternatives, controlling the trains to keep them operating in a safe and efficient manner becomes more complex. For example, as two trains approach one another from opposite directions, in order to avoid a collision, one of the trains must be switched to another track. Similarly, as two trains approach one another from the same direction, i.e., on the same track with the one behind the other travelling at a faster speed than the train in front, either the train in front must be sped up, or the one behind must be slowed down. Accordingly, Railways are provided with signaling primarily to ensure that there is always enough space between trains to allow one to stop before it hits the one in front.

In typical systems, signaling is achieved by dividing each track into sections or "blocks", which is a length of track of defined limits. The length of a block is usually determined to be the distance it takes a train, running at full speed, to come to a complete stop under the worst possible conditions. Each block is protected by a signal placed at its entrance. If the block is occupied by a train, the signal will display a red "aspect", to instruct the conductor to stop the train. If the section is clear, the signal can show a green or "proceed" aspect.

A track circuit is typically the mechanism by which the presence of a train in a block is usually detected. Many rail-lines with moderate or heavy traffic are equipped with color light signals operated automatically or semi-automatically by track circuits. When the track circuits detect a train, the signal shows a red aspect. If no train is detected and the circuit is complete and the signal shows a green aspect (or yellow, in a multi-aspect signaled area).

A low voltage from a battery is applied to one of the running rails in the block and returned via the other rail. A relay at the entrance to the section detects the voltage and is energized to connect a separate supply to the green lamp of the signal.

When a train enters the block, the leading wheelset short circuits the current, which causes the relay to de-energize and drop the contact so that the signal lamp supply circuit activates a red signal lamp. The system is "fail-safe", or "vital" as it is sometimes called, when any break in the circuit will cause a danger signal to be displayed.

The above is a simplified description of a track circuit. Actually, a "fixed-block" section is conventionally electrically separated from its adjacent sections by insulated joints in the rails. However, more recent installations use electronics to allow jointless track circuits. Also, some areas have additional circuits which allow the signals to be manually held at "red" from a signal box or control center, even if the section is clear. These are known as semi-automatic signals.

The development of signaling and train control technology can generally be separated into two periods, with 1920 as the dividing point. Before 1920, the major areas of technological advance were interlocking control and block signaling (manual and automatic).

After 1920, the demand for moving heavier traffic at higher speeds and with increased safety led to major developments such as centralized traffic control, continuous cab signaling, coded track circuits, and automatic train control (ATC). Generally, innovative signaling and train control technology for rail rapid transit was derived from railroads and lagged behind railroad application by about 10 years. There were some notable exceptions; the development of automatic junction operation and automatic train dispatching was pioneered in rail rapid transit. Very recently, since roughly 1960, there has been some experimentation with techniques and equipment solely for rail rapid transit and small people-mover systems.

Over the years, technological advances in several areas of communication has lead to vast improvements in train control. For example, centralized control has typically replaced the need for block signaling such as described above.

The original and most important purpose for control devices and/or systems is to prevent collisions between vehicles moving in the track network. For this purpose, as mentioned above, it has been known to divide the line into blocks and to prevent, by central control, any train from entering into a block unless the block is free of other vehicles. This "real-block" type of system may be suitable for less dense traffic, however, it is not suitable for use within track networks where the traffic has to be dense and where the length of the blocks would, thus, have to be extremely short, leading to major investment and control cost.

One known conventional system provides a calculation of the movement within a block by means of a message sent to a central unit from the train about its speed. The central unit then performs a distance calculation by multiplying the train's speed by the desired time increment. Accordingly, the speed may be centrally controlled if a collision risk occurs. By being able to determine, at least approximately, the position within a block of each train, several trains can be permitted into the same block as long as the central surveillance unit, as well as the communication with the train, functions properly. By using this method of calculating train positions, however, the position determinations obtained are so uncertain, that either the blocks must be made very small, so that the calculation must be updated frequently, or the number of allowed trains within the same block must be strictly limited. Also, as the demand to increase traffic density rises, prohibitively small blocks would be required, making it practically impossible to build such a system at a reasonable cost and with a reasonable control capacity.

Another known conventional train control system also includes dividing the tracks into blocks where, within each block, movement of the train is determined by means of a rotation meter on the wheels of each train. The position determination within the block is then made centrally by emitting clock pulses that are returned by the train with a delay corresponding to the distance of travel within the block, measured by the rotation meter.

In both of the conventional systems mentioned above, the passage of each train past a block borderline is reported to the central unit, whereupon information about speed and distance traveled is repeatedly determined. The central unit calculates the location of each train within the block and controls the velocity of at least one of the trains to avoid a collision, if two or more, trains are approaching each other.

The conventional systems, thus described, require a physical division of the track network into blocks, with installations that, when passed by a mobile unit on each train, trigger the central unit calculation of the distance traveled by means of a repeated exchange of information between the central unit and the mobile units. This results in a requirement for very frequent communication between the central unit and each mobile unit. Should this communication break down, for any reason during a period of time, the security of the position determination is lost. This might indicate that cable-based signal transmission should be chosen for safety reasons. As the methods used for calculation of the distance traveled will necessarily produce a result having considerable tolerances, the blocks must have a limited length unless the safety distances between the trains can be made very long.

The mentioned systems are primarily applicable to train traffic over longer distances on railway lines, as their traffic generally is not so frequent and the safety distances can be made long. This makes a division of the railway line into blocks of considerable length, and thus of limited number, possible. For urban tramways, however, the conditions are considerably more complicated as dense traffic, as well as strongly varying speeds, is necessary. Under these conditions, the blocks would have to be very short in order for the tolerances of the calculated distance traveled within the block to not risk the safety of the position determination.

A communications-based train control system has been suggested wherein the concept of dividing the track network into blocks is eliminated and there is thus no indication to a central unit of the passing of each train past block borderlines. Instead, the position within the track network of each train is calculated on-board each train by distance measurements taken during travel. In order for the position determination to be held within close enough tolerances such that dense traffic can be permitted without safety risks, a calibration of the position determination process is performed over a series of short intervals by passive elements at determined fixed points, by means of transponders scanned by radio equipment on board the train. The determined position of the train is then transmitted by wireless communication to a central unit, which may thereby calculate the distance between different trains, for speed control and for any possible emergency braking.

Specifically, in accordance with the above-mentioned system, the mobile unit on-board the train includes distance meters. The distance meters further include pulse counters mounted on the wheel axles and are used for measuring the distance traveled during a particular time interval. In this way, the position and the speed of the train can be determined. In practice, at least two measuring wheels are necessary in order to detect slippage, blockage and any possible pulse counter function errors.

A distance meter, however, will unavoidably lead to an accumulated error in the distance measurement. For example, wheels of a train have a tendency to "slip," "slide" and "spin" referring to various situations where the rotational speed of the wheels does not correspond with the actual rolling contact between the wheel tread and the rail surface. Accordingly, redundant counters are often used and calibration of the measured distance must be performed often. In the system mentioned here, calibration takes place every time the train passes a fixed number of points in the track network and is preferably performed at every stop. Calibrating the distance measurement is done by a radio frequency sensor on-board the train that registers the passage of a passive transponder placed in the ground between the tracks or suspended from the current supply line.

In addition, U.S. Pat. No. 4,735,383 describes a railway control system in which a plurality of transponders are positioned at intervals spaced along a track. Each passing train within the system has radio equipment for reading the identity of a passed transponder. Each train then transmits the transponder identity and information about its own identity to a central station. The central station then provides each train with signaling information. The central station, however, provides signaling information to only one train at a time using a single radio channel. Because individual messages are sent serially to each of the trains, this system requires the central station to provide very short broadcasts to each train.

U.S. Pat. No. 5,740,046 describes a method for controlling vehicles in a tram line which uses a number of passive beacon tags to determine a tram's position. In this system, the length of the tracks is divided into separate cells. A central system communicates with the trams by sending messages, each of which is intended for an individual tram. In order to only reach an individual tram, each messages is transmitted only within the individual cell in which the intended tram is located. To reach all of the trams within a track area would therefore require multiple transmissions from the central system.

Thus, it would be advantageous to use a vehicle control system that provides a simple transmission of detailed information to all of the trains within a track area.

SUMMARY OF THE INVENTION

The present invention is directed to a vehicle control system and method in which a plurality of beacon tags are disposed along a length of a track for a predetermine number of blocks. The beacon tags each provide identification information pertaining to the tag's location.

Each vehicles that passes along the track has a tag reader that solicits information from the beacon tags and a transmitter that transmits the solicited information, as well as vehicle identification information for the transmitting vehicle, to a wayside control unit. The wayside control unit receives the transmitted position information and vehicle identification information and in turn transmits a single broadcast of information pertaining to each of the blocks of the predetermined number of blocks. This signal is received by all of the vehicles, which use only the information about immediately approaching blocks.

In addition, dynamic tags located at positions along the length of the predetermine number of blocks can be used as a backup system for providing the same information that is provided by the wayside control unit.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE PREFERRED EMBODIMENTS

The preferred embodiment of the present invention will now be discussed. While a specific configuration for the present invention is discussed below, i.e., a rail guided train system, it should be understood that this is done for illustration purposes only. A person skilled in the relevant art will recognize that other components and configurations may be used without departing from the spirit and scope of the invention, such as applying the invention to other vehicles such as trams or streetcars.

Figure 1:
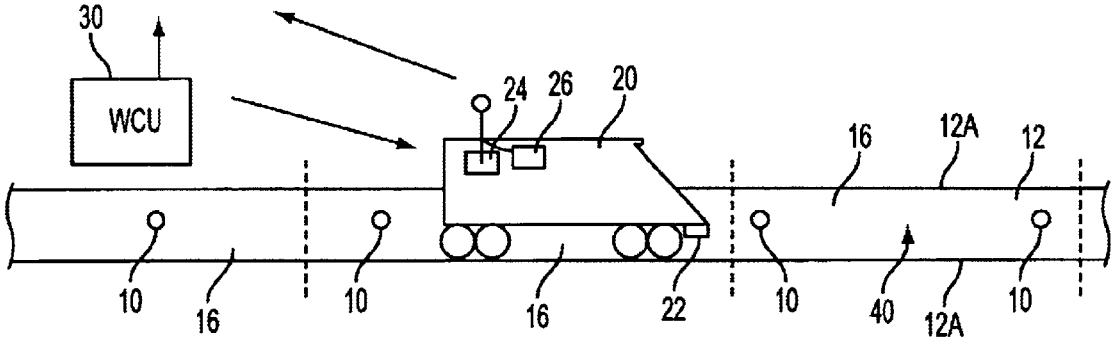
FIG. 1 is a diagram of the vehicle control system.

Referring to FIG. 1, the system includes beacon tags 10 disposed along the length of a track 12, trains 20 that have tags readers 22 and transmitters 24, and a wayside control unit 30 that preferably transmits information to all trains 20 within an area 14.

The plurality of beacon tags 10 are disposed along a length of the track 12 for the area 14 consisting of a predetermined number of blocks 16. The tag readers 22 located on the trains 20 solicit information from the beacon tags 10. The transmitters 24 then transmit the solicited information, as well as vehicle identification information for the train 20, to a wayside control unit 30. The wayside control unit 30 receives the transmitted position information and vehicle identification information from all of the trains within the area 14 and then transmits a single broadcast of information pertaining to each of the blocks 16 of the area 14. This signal is received by all of the trains 20 within an area, which in turn use only the information about approaching blocks 16.

The beacon tags 10 are preferably passive RF transponders which provide information only when asked. For example, when a tag reader 22, which can be a transponder transmitter, requests information from the beacon tag 10, the beacon tag 10 responds with whatever information it may have stored within itself. The beacon tags 10 are preferably provided every few meters over the entire length of the track 12 and are located between the rails 12A. Each beacon tag 10 has stored within it at least the following information; tag location identifying precisely where, along the track, the tag is physically located; information regarding the distance to the next, adjacent, identification tag; the identification of the next adjacent identification tag; and information relative to the track 12 profile. Track profile information includes information about the location and severity of track grades and track curves, as well as information about maximum vehicle density within areas of the track. When a train 20 travels within a close proximity of a beacon tag 20, a tag reader 22 on the train requests the identifying information from the beacon tags 10.

An onboard computer (not shown) then stores and processes the identification information received from all beacon tags 10 and displays the processed information in a formatted fashion on a display monitor (not shown) visible to a train conductor or other personnel onboard the train 20. This processed information can include, for example, the current train speed and the train's location. The information from the beacon tags 10, as well as information about the train's 20 identity is also transferred to the transmitter 24, for transmission to the wayside control unit 30.

The wayside control unit 30 receives information from all of the trains 20 regarding the identity and position of all trains within the wayside control unit's area 14. The wayside control unit 30 then processes the information about each train's 20 identity, each train's location, and the track 12 profile, as well as stored information about the train's 20 past locations. Using this information, the wayside control unit 30 is able to calculate information about the status of each of the blocks 16 within the area 14. This status information includes information can include, for example, the allowable speed within each block 16, information about the closing of blocks 16, and information about any required track switching.

The wayside control unit 30 then transmits a single broadcast pertaining to, preferably, all of the blocks 16 within the area 14. The broadcast is received by receivers 28 on each of the trains 20. Individual trains 20 receive the information about all of the blocks 16 but only utilize the information about the block 16A in which the train 20A is currently located and the blocks 16 that the train 20A is approaching. The individual trains 20 then use this information to control their speed, to stop when appropriate, or to perform track switching when appropriate.

When calculating the information, the wayside control unit 30 uses the information sent from the trains 20 to determine the locations of the trains 20 within the area 14, the wayside control unit 30 assigns a block 16 of track 12 behind each subject train 20 as closed to prevent accidents and assigns the blocks 16 where a train can safely travel as open. The system can be used for opening or closing blocks 16 in either a fixed block control system or a "pseudo-moving block" control system. In either of these systems, information about the status of blocks 16 is transmitted to the trains 20 by the wayside control unit 30.

Figure 2:
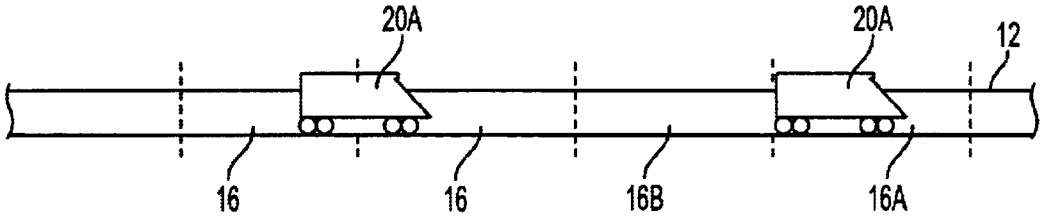
FIG. 2 is a diagram of the vehicle control system using fixed blocks.

Referring to FIG. 2, for a fixed block system blocks are static blocks with predetermined sizes. The block 16A in which a subject train 20A is traveling is said to have a red aspect associated with it. The block 16B immediately behind the subject train 20A, equal in distance to the length of track 12 it would take for the subject train 20A to safely come to a complete stop, given its present speed, is said to have a yellow aspect, and the block 16C immediately behind the "yellow" block is said to have a green aspect.

Figure 3:
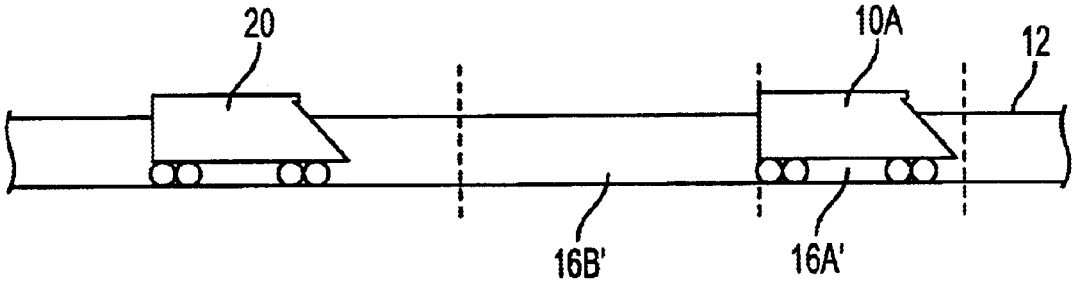
FIG. 3 is a diagram of the vehicle control system using pseudo-moving blocks.

Referring to FIG. 3, because in this system the speed of each train 20 and the profile of the track 12 are known, it is possible to provide what is called a pseudo-moving block. In a pseudo-moving block system, the block 16A' associated with each train 20A moves. The space occupied by a train 20 at any given moment is that train's block 16A', regardless of the train's 20A movement. The block 16A moves along with the train 20A, unlike a "fixed" block system in which each block 16 is distinct from any train 20 that happens to be traveling within its boundaries. Further, because the profile of the track 12 and other factors, such as weather conditions, the location and speed of other nearby trains 20, the size the blocks 16 near the block 16A in which each train 20A is traveling is dynamic.

For example, as a train 20A located on the tracks 12 somewhere behind another slow moving train 20 begins to speed up, relative to the slow moving train 20, the "red"

pseudo block 16B' immediately behind the slow moving train may increase in size, allowing for a greater stopping distance associated with the train that is speeding up. Also, with respect to track profile, if it is known that a sharp curve, requiring severely reduced speeds in order to safely traverse, is approaching relative to a given train, the length and aspects of the blocks behind that train can be adjusted to accommodate for the anticipated reduction in speed of the train.

In addition, dynamic tags 40 located at positions along the length of the area 14A can be used as a backup system for providing information that is similar to the information provided by the wayside control unit 30. Unlike the beacon tags 10, the dynamic tags 40 does not need to be solicited in order to transfer the data stored within it. For example, a dynamic tag 40 can be controlled to transmit certain data to a train 20, whenever the tag reader 22 or its corresponding antenna, is close enough to the dynamic tag 40. Dynamic tags 40, like the beacon tags 10, are located along the entire length of the track 12; however, dynamic tags do not need to be located as close together as the beacon tags 10.

It is of course understood that departures can be made from the preferred embodiment of the invention by those of ordinary skill in the art without departing from the spirit and scope of the invention that is limited only by the following claims.

What is claimed is:

1. A vehicle control system, comprising:

a wayside control unit;

a plurality of beacon tags, each beacon tag providing information pertaining to its location, wherein the beacon tags are disposed along a length of a track for a predetermined number of blocks;

a tag reader disposed on each of a plurality of vehicles that solicits the information from the beacon tag;

a transmitter disposed on each of the vehicles that transmits the solicited information from the beacon tags and vehicle identification information for the respective vehicles to the wayside control unit, wherein the wayside control unit receives the information transmitted by the transmitter and transmits a single broadcast of information pertaining to each of the blocks of the predetermined number of blocks to all of the plurality of vehicles; and a receiver disposed on each of the vehicles that receives the single broadcast.

2. The vehicle control system of claim 1, further comprising dynamic tags located at positions along the length of the predetermine number of blocks, wherein the dynamic tags transmit a single broadcast of information pertaining to all of the blocks within the predetermined number of blocks.

3. The vehicle control system of claim 1, wherein the single broadcast includes at least one of information about allowable speed within each block, information about the closing of blocks, and information about track switching.

4. The vehicle control system of claim 1, wherein the single broadcast is a repetitive signal.

5. The vehicle control system of claim 1, wherein each beacon tags further provides information about the identity and position of the next beacon tag.

6. The vehicle control system of claim 1, wherein the beacon tags also provide track profile information including at least one of track grade, track curve, or maximum allowable speed.

7. The vehicle control system of claim 1, wherein the blocks are fixed blocks.

8. The vehicle control system of claim 1, wherein the blocks are pseudo-blocks.

9. The vehicle control system of claim 1, wherein each of the plurality of beacon tags is an RF tag separated from an adjacent beacon tag by a few meters.

10. The vehicle control system of claim 2, wherein the single broadcast includes at least one of information about allowable speed within each block, information about the closing of blocks, and information about track switching.

11. The vehicle control system of claim 2, wherein the single broadcast is a repetitive signal.

12. The vehicle control system of claim 2, wherein each beacon tag further provides information about the identity and position of the next beacon tag.

13. The vehicle control system of claim 2, wherein each beacon tag also provides track profile information including at least one of track grade, track curve, or maximum allowable speed.

14. The vehicle control system of claim 2, wherein the blocks are fixed blocks.

15. The vehicle control system of claim 2, wherein the blocks are pseudo-moving blocks.

16. The vehicle control system of claim 2, wherein each of the plurality of beacon tags is an RF tag separated from an adjacent beacon tag by a few meters.

17. A method of controlling vehicles, comprising:

providing information pertaining to the location of one of a plurality of beacon tags to vehicles passing the one of the plurality of beacon tags, wherein the beacon tags are disposed along a length of a track for a predetermined number of blocks;

transmitting the information pertaining to the location of the one of the plurality of beacon tags and vehicle identification information for the respective vehicle to a wayside control unit; and transmitting position information and vehicle identification information from a wayside control unit using a single broadcast of information pertaining to each of the blocks within the predetermined number of blocks to all of the plurality of vehicles.

18. The method of controlling vehicles of claim 17, further comprising transmitting a single broadcast of information pertaining to all of the blocks within the predetermined number of blocks from dynamic tags located at positions along the length of the predetermine number of blocks.

19. The method of controlling vehicles of claim 17, wherein the single broadcast includes at least one of information about allowable speed within each block, information about the closing of blocks, and information about track switching.

20. The method of controlling vehicles of claim 17, wherein the single broadcast is a repetitive signal.

21. The method of controlling vehicles of claim 17, further comprising providing information about the identity and position of the next beacon tag.

22. The method of controlling vehicles of claim 17, further comprising providing track profile information including at least one of track grade, track curve, or maximum allowable speed from the beacon tags.

23. The method of controlling vehicles of claim 17, wherein the blocks are fixed blocks.

24. The method of controlling vehicles of claim 17, wherein the blocks are pseudo-moving blocks.

* * * * *